United States Patent [19]

Corcoran

[11] Patent Number: 4,661,694

[45] Date of Patent: Apr. 28, 1987

[54] INFRARED STREAK CAMERA

[76] Inventor: Vincent J. Corcoran, P.O. Box 953, McLean, Va. 22101

[21] Appl. No.: 775,679

[22] Filed: Sep. 13, 1985

[51] Int. Cl.[4] ..... H01J 40/14; H01J 40/00

[52] U.S. Cl. ..... 250/213 VT; 313/542

[58] Field of Search ..... 250/213 VT; 313/384, 313/528, 542

[56] References Cited

U.S. PATENT DOCUMENTS 3,598,998 8/1971 Becker .
3,612,896 10/1971 Firester .
3,624,406 11/1971 Martin et al. .
3,629,601 12/1971 Firester .
3,629,602 12/1971 Firester .
3,629,603 12/1971 Andrews .
4,429,393 1/1984 Giuliano .
4,431,914 2/1984 Mourou et al. ..... 250/211 J

OTHER PUBLICATIONS

C. Loth et al., "Ultraviolet 45-GW Coherent Pulse for Laser Matter Interaction—," *Applied Optics*, vol. 19, No. 7, Apr. 1, 1980.

*Primary Examiner*—Gene Wan
*Attorney, Agent, or Firm*—Bernard, Rothwell & Brown

[57] ABSTRACT

A non-phase-matchable nonlinear plate such as amorphous zinc sulfide or zinc selenide is inserted in front of a conventional streak image generator with high sensitivity to visible radiation to produce an infrared streak camera arrangement with improved sensitivity and decreased cost.

3 Claims, 2 Drawing Figures

INFRARED STREAK CAMERA

TECHNICAL FIELD

The present invention relates to streak cameras which convert a pulse or a selected duration of incident radiation into a spatial representation of the temporal variations in the pulse, and particularly to a streak camera for viewing incident infrared pulses.

PRIOR ART

Streak cameras are useful for viewing or studying pulses, and particularly very fast pulses, i.e., less than 10 nanoseconds, produced by lasers and the like. A conventional streak camera system includes a streak tube having a photocathode on which a lens projects an image of a slit in the path of the incident radiation pulse. The photocathode converts a portion of the incident radiation (photons) into electrons which are accelerated by a high voltage electrostatic field to form a beam of electrons. This beam is passed through a deflection field which is synchronized with the incident radiation pulse to rapidly sweep the beam across microchannel plates (MCP). The microchannel plates multiply the intensity of the electron beam and pass the intensified beam to a phosphor screen to produce a visible light streak or image which has variations along its length corresponding to the variations relative to time of the incident radiation pulse. This streak image is recorded by a camera such as a silicon intensified target (SIT) vidicon camera connected to an analyzer and a TV monitor for producing a permanent record of the streak image which can be leisurely studied and analyzed. In addition, the streak camera system includes a PIN photodiode for generating trigger signals, a delay unit for adjusting the delay time of the triggering signal, a chart recorder as an output device, and a host computer for post-processing of the recorded signal.

One type of commercially available streak camera employs a photocathode including a S-20 surface which has a relatively high sensitivity (500 mA/W @532 nm). The S-20 surface however has no measurable response to radiation with a wavelength greater than about 700 or 1,000 nm and thus is not useable for producing a streak image of an infrared laser pulse. Another commercially available streak camera employs a photocathode with a S-1 surface which responds to radiation greater than 1,000 nm up to about 1,500 nm; however, this streak camera with an S-1 photocathode surface typically costs in the order of $12,000 more than a streak camera with an S-20 surface. Furthermore, longer wavelength infrared radiation, for example, at 2,000 nm, cannot be detected with any photocathode surface.

The prior art also contains a number of frequency multiplying crystals which are formed from materials having a non-linear response to a high intensity incident infrared radiation for converting a portion of the incident radiation into second or third harmonic or visible radiation. In order to convert any substantial portion of the incident infrared radiation into visible radiation, the frequency multiplier crystal must be phase matched, i.e., the crystal must have an orientation along the path of incident radiation where the propagation velocity of the generated harmonic matches the propagation velocity of the fundamental or incident radiation. Otherwise the generated harmonic will fall out of phase with the incident radiation so that the newly-generated harmonic radiation and out of phase harmonic radiation will cancel each other resulting in very little harmonic generation. Phase matched nonlinear crystals have been employed to convert substantial portions of incident infrared radiation into visible radiation which is then viewed by a streak camera. However, the phase matching requirement for frequency multiplication renders use of such frequency multiplying crystals impractical in streak cameras. The phase matching is very sensitive to the frequency of incident radiation so that a crystal with a selected orientation can only be used for a single frequency of incident radiation and further the incident beam must be precisely orientated relative to the crystal to produce phase matching. Separate frequency doubler crystals, if available, and/or separate orientations would have to be employed for each different incident signal.

SUMMARY OF THE INVENTION

The invention is summarized in the employment of a plate of nonlinear non-phase-matchable material in combination with the high sensitivity of a photocathode responsive to visible radiation to produce a streak camera arrangement capable of viewing and recording infrared incident pulses.

An object of the invention is to produce an infrared responsive streak camera which is substantially less expensive than prior art infrared streak cameras.

Another object of the invention is to produce an infrared responsive streak camera which is responsive to infrared pulses heretofore unviewable by any streak camera regardless of the cost.

One advantage of the invention is that a wide spectrum of infrared radiation pulses can be viewed by a single streak camera arrangement.

Another advantage is that a nonlinear non-phase-matchable material is not as sensitive to the angle of incident radiation as phase-matchable crystals are and thus the field of view is not limited.

A feature of the invention is the recognition that non-phase-matching materials having a high nonlinear coefficient to infrared radiation can be employed in combination with a streak camera having a photocathode with a relatively high response to visible radiation in order to produce a streak camera having greater sensitivity to coherent radiation than prior art infrared streak cameras employing an infrared responsive photocathode.

Other objects, advantages and features of the invention will be apparent from the following description of the preferred embodiment taken in conjunction with the accompanying drawings wherein:

DESCRIPTION OF THE PREFERRED EMBODIMENTS

Figure 1:
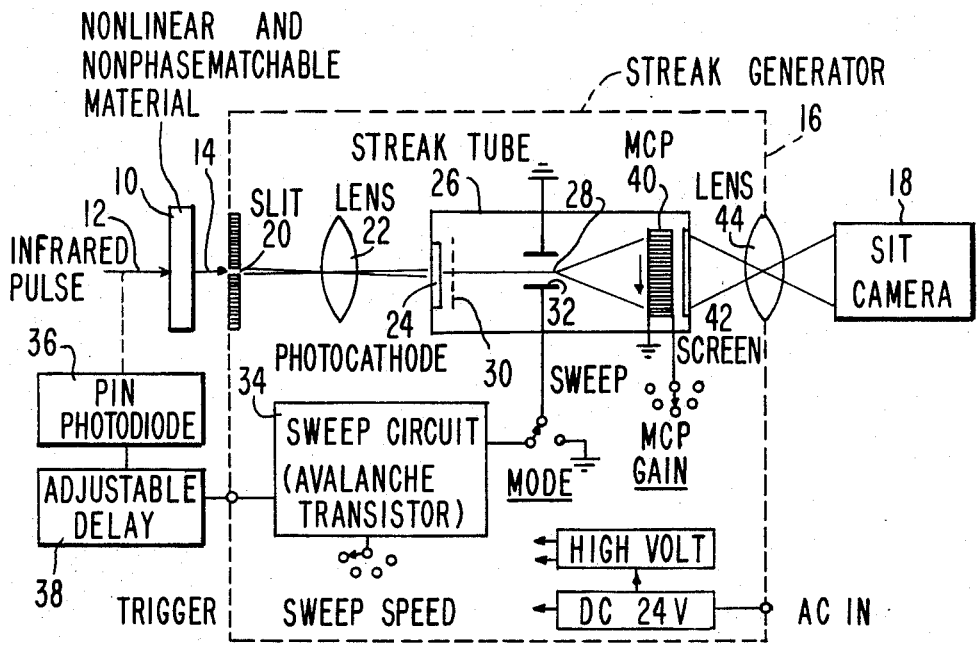
FIG. 1 is a diagrammatic illustration of an infrared streak camera constructed in accordance with the invention.

As shown in FIG. 1, one embodiment of the invention employs a plate 10 of nonlinear non-phase-matchable material which is interposed in the path of an infrared incident beam 12 for converting a portion of the infrared beam 12 into visible radiation in a beam 14 to a conventional streak generator 16 which produces a streak image of the visible radiation in the incident beam 14. A conventional camera arrangement such as SIT camera arrangement 18 is included for recording the streak image for subsequent viewing and/or analysis.

The streak camera 16 has an input slit 20 upon which the incident beam 14 containing visible radiation is directed. A lens 22 produces an image of the slit 20 on a photocathode 24 of a streak tube 26. The photocathode 24 in the streak generator employed with the invention, has a relatively high response to visible radiation for producing a beam 28 of electrons which is accelerated through a high voltage grid 30. The photocathode 24 generally has a sensitivity to produce a electron current greater than about 200 milliamps per watt of incident visible radiation, and preferably is a S-20 surface to produce an electron current of about 500 milliamps per watt of incident radiation of about 532 nm. After acceleration by the grid 30, the beam 28 passes through a deflection field, such as produced by deflection plates 32 operated by a sweep circuit 34 which is triggered by a signal from a PIN photodiode 36 which passes through an adjustable delay unit 38 for adjusting the delay time of the triggering signal. The deflection field causes a rapid sweep of the electron beam 28 across microchannel plates (MCP) 40 where the electron beam is multiplied by secondary emission of electrons by a factor up to 1000 or more. The intensified beam from the MCP 40 impinges upon a phosphor screen 42 wherein the impinging electrons are converted to visible light to thus produce a streak image on the screen 42. A lens 44 projects the streak image on the SIT camera arrangement for viewing and analysis.

The nonlinear non-phase-matchable plate 10 is formed from a material which is transparent to the infrared radiation as well as to the generated harmonic radiation, and is selected to have a high nonlinear coefficient for generating harmonic frequency. Particularly suitable materials are amorphous materials such as pressed zinc sulfide (IRTRAN 2) or zinc selenide. Typically, only about 0.1% of the incident infrared radiation is converted into visible harmonic radiation. This is considerably less than conversion efficiencies attainable where phase matching is employed resulting in up to 15 to 20% or more conversion of incident infrared radiation into visible radiation.

In spite of the relatively low conversion efficiency, it has been discovered that a nonlinear and non-phase-matchable frequency conversion plate, when employed in combination with a streak generator having a high visible radiation sensitivity, can produce an infrared responsive steak camera with a substantial cost reduction as well as an improved sensitivity. A typical photocathode, such as a S-20 surface, has a sensitivity to visible radiation which can be about 500 milliamps per watt of incident radiation at 532 nm. However, the prior art infrared streak cameras employ a S-1 photocathode surface which has a sensitivity of more than 3 orders of magnitudes less, i.e., a sensitivity of about 200 microamps per watt of incident radiation at 1064 nm. Even with a conversion efficiency of 0.1%, there is produced a sensitivity gain of about 2.5 compared with prior art infrared streak cameras, i.e., conversion efficiency (0.001) times S-20 sensitivity (0.5 amperes) divided by S-1 sensitivity (0.000200 amperes) equals 2.5. Additionally, the streak camera arrangement of the present invention results in a cost reduction of at least about $10,000 over prior art streak cameras employing infrared responsive photocathodes.

The present invention further enables the employment of a streak camera for radiation which is not heretofore been viewable in a practical manner by prior art streak cameras. For example, 2,000 nm radiation cannot be detected with any photocathode surface. However, a nonlinear non-phase matchable plate could frequency double or triple a portion of such low frequency incident radiation to generate radiation which can be detected by a S-1 surface or an S-20 surface. Also, there are infrared frequencies where no phase-matching crystals can be found to produce a phase-matched converter for such frequencies and thus the prior art could not analyze pulses of certain low radiation frequencies.

Further, the field of view of the camera with a non-phase-matchable optical frequency converter is much greater than one in which a phase-matchable crystal might be used because of the narrow acceptance angle of a phase-matchable crystal.

Figure 2:
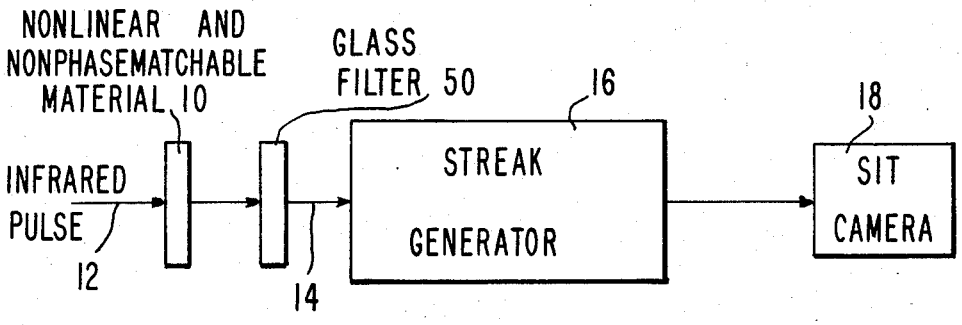
FIG. 2 is a diagrammatic illustration of a modified infrared streak camera arrangement constructed in accordance with the invention.

A modification of the steak camera arrangement is shown in FIG. 2 wherein a glass filter 50 is interposed between the nonlinear non-phase-matchable plate 10 and the streak generator 16. The glass filter 50 is selected to attenuate or greatly reduce the intensity of infrared radiation to avoid damage to the streak generator 16.

Since many modifications, changes in detail and variations may be made to the above-described embodiments, it is intended that all matter shown in the foregoing description and shown in the accompanying drawings be interpreted as illustrative and not in a limiting sense.

What is claimed is:

1. A streak camera arrangement for viewing a spatial representation of an incident infrared pulse, comprising:

a streak generator including a photo-cathode non-responsive to infrared radiation but responsive to visible radiation for producing a beam of electrons from an incident pulse of visible radiation, means for multiplying the intensity of the beam of electrons generated by the photocathode, a phosphor display screen for converting the multiplied beam of electrons into visible radiation, and means for sweeping the multiplied beam of electrons across the display screen to produce a streak image;

camera means for recording a streak image produced on the display screen; and a frequency multiplier plate formed from a nonlinear non-phase-matchable material disposed in the path of the incident infrared pulse to convert a portion of the incident infrared pulse into the incident pulse of visible radiation.

2. A streak camera arrangement as claimed in claim 1 wherein the photocathode of the streak generator has a response to visible radiation producing more than 200 milliamperes of electron current per watt of incident visible radiation.

3. A streak camera as claimed in claim 2 wherein the frequency multiplier plate is amorphous zinc sulphide or amorphous zinc selenide.

* * * * *